US005394052A

United States Patent [19]

Oh

[11] Patent Number: 5,394,052

[45] Date of Patent: Feb. 28, 1995

[54] SHADOW MASK FRAME ASSEMBLY

[75] Inventor: Tae-Sik Oh, Buk, Rep. of Korea

[73] Assignee: Samsung Electron Devices Co., Ltd., Kyunggi, Rep. of Korea

[21] Appl. No.: 894,911

[22] Filed: Jun. 8, 1992

[30] Foreign Application Priority Data

Jun. 8, 1991 [KR] Rep. of Korea ..... 91-8415

[51] Int. Cl.[6] ..... H01J 29/07

[52] U.S. Cl. ..... 313/405; 313/406; 313/407

[58] Field of Search ..... 313/405, 406, 407, 404

[56] References Cited

U.S. PATENT DOCUMENTS 3,660,708 5/1972 Nakamura et al. ..... 313/405
3,823,336 7/1974 Nakamura et al. ..... 313/405
4,315,189 2/1982 Goto et al. ..... 313/405
4,659,958 4/1987 D'Amato ..... 313/405

*Primary Examiner*—Donald J. Yusko
*Assistant Examiner*—Ashok Patel
*Attorney, Agent, or Firm*—Leydig, Voit & Mayer

[57] ABSTRACT

A shadow mask frame assembly includes hook springs made of a plate-like bimetal member whose outer side is a high-expansion side and inner side is a low-expansion side, is fixed on a frame in the direction of an electron beam proceeding axis, and is nearly L-shaped to have a fixing portion welded to the base of the frame and a fitting portion having a fitting hole into which a stud pin on the inner side of a panel is fitted. The shadow mask frame assembly is not distorted or rotated with respect to the panel during the thermal expansion of a shadow mask due to electron beam collision, and is sufficiently compensated only in the direction of the electron beam's proceeding axis.

14 Claims, 4 Drawing Sheets

SHADOW MASK FRAME ASSEMBLY

BACKGROUND OF THE INVENTION

The present invention relates to a shadow mask frame assembly for a CRT, and more particularly to an improved hook spring for fixedly installing the shadow mask frame assembly to a stud pin on the inner side of a panel.

Generally, as shown in FIG. 1, a CRT comprises a shadow mask 6 for performing a color selection function to land an electron beam 2 projected from an electron gun 1 onto a phosphor surface 5 formed on the inner surface of a panel 3. Shadow mask 6 with countless electron beam-passing holes *7a* has a beam-passing plane 7 perpendicular to a proceeding axis X—X of the electron beam and is welded to flames 9 by skirts 8 formed on the periphery of the shadow mask.

As shown in FIG. 2, a plurality of hook springs 10 having a fixing hole are fixed to the outer surface of frame 9 perpendicular to the electron beam proceeding axis X—X and in the same rotational direction. Respective stud pins 4 formed on the inner surface of panel 3 are fitted into the fixing holes of hook springs 10 so that shadow mask 6 is mounted onto panel 3, staying a certain distance apart from the inner surface of panel 3.

However, only 15–18% of electron beam 2 projected from electron gun 1 passes through electron beton-passing holes *7a* of shadow mask 6, and the remainder collides against shadow mask 6. The colliding rays of electron beam 2 heat shadow mask 6 which is thermally expanded to have a doming phenomenon wherein the center portion of shadow mask 6 swells. Due to the doming, the periphery of shadow mask 6 has a greater discordance between the proceeding axis X—X of electron beam and electron beam passing holes *7a* so that, in effect, electron beam 2 does not precisely land on phosphor surface 5, causing the deterioration of the picture's colorimetric purity. Such a problem can be solved by moving shadow mask 6 slightly toward phosphor surface 5 so as to accord electron beam-passing holes *7a* with the proceeding axis X—X.

In FIGS. 3A, 3B and 3C, a conventional hook spring 10 for compensating for the shadow mask's position is illustrated which suppresses the reduction of colorimetric purity. One end of hook spring 10 is fixedly welded to frame 9 via a bimetal member 12 welded on the frame's outer side. A fixing hole 11 for fitting stud pin 4 of panel 3 is formed on the free end of hook spring 10. The bimetal member 12 is affixed to frame 9 so that, during thermal expansion of shadow mask 6 and frame 9, shadow mask 6 moves toward phosphor surface 5 of panel 3. In some cases, in order to cope with thermal expansion, the hook spring 10 is made of a plate-like material called parallel stick-together (PST) which is a stack of metals having different thermal expansion coefficients.

When the temperature of bimetal member 12 goes up, the conventional hook spring 10 expands most in an unwelded portion so that the hook spring is distorted in the direction of the electron beam's proceeding axis as well as perpendicular thereto, by certain angles $\Theta 1$ and $\Theta 2$. Thus, the shadow mask frame assembly is moved by a certain distance toward the phosphor surface to compensate for the landing position of the electron beam with respect to the thermal deformation of shadow mask 6.

However, since the movement of the conventional shadow mask frame assembly is determined by the deformation angle $\Theta 1$ of hook spring 10 in the direction the beam's proceeding axis and by the deformation angle $\Theta 2$ of hook spring 10 in the direction perpendicular to the beam's proceeding axis, the shadow mask frame assembly becomes abnormally rotated or distorted. This hinders the sufficient compensation for the position of shadow mask 6 with respect to its thermal expansion. Further, the conventional shadow mask frame lo assembly has a complicated manufacturing process in which a bimetal member 12 is welded onto locations around frame 9 and hook spring 10 is welded to each bimetal member 12. Besides, since the shadow mask frame assembly is supported by hook spring 10 extended from bimetal member 12 by a certain distance, the assembly is easily shaken by minor external impacts.

SUMMARY OF THE INVENTION

Therefore, it is an object of the present invention to provide a shadow mask frame assembly whose structure is simple and easy to manufacture which, prevents panel rotation and distortion during thermal expansion to enable sufficient thermal expansion compensation, and which prevents vibration due to external impacts.

To accomplish the object, the shadow mask frame assembly of the present invention comprises a shadow mask, a frame for fixing the shadow mask, and a plurality of hook springs fixed to the frame and coupled with a stud pin on the inner side of the panel, wherein the hook springs are made of a plate-like bimetal member whose outer side is a high-expansion side and whose inner side is a low-expansion side, is fixed on the frame in the direction of an electron beam proceeding axis, and is nearly L-shaped to have a fixing portion welded to the base of the frame and a fitting portion having a fitting hole into which the stud pin on the inner side of the panel is fitted.

Since the hook spring is fixed to the frame in the direction of the electron beam proceeding axis, the shadow mask frame assembly of the present invention is not distorted or rotated with respect to its panel during the thermal expansion of a shadow mask due to electron beam collision, and is sufficiently compensated only in the direction of the electron beam's proceeding axis. In addition, the present invention can maintain stability without vibrating despite external impacts. Moreover, the manufacture of the present invention is very easy since conventional bimetal and hook springs are of a stacked bimetal material.

BRIEF DESCRIPTION OF THE DRAWINGS

The above object and other advantages of the present invention will become more apparent by describing in detail a preferred embodiment of the present invention with reference to the attached drawings in which.

DETAILED DESCRIPTION OF THE INVENTION

Figure 1:
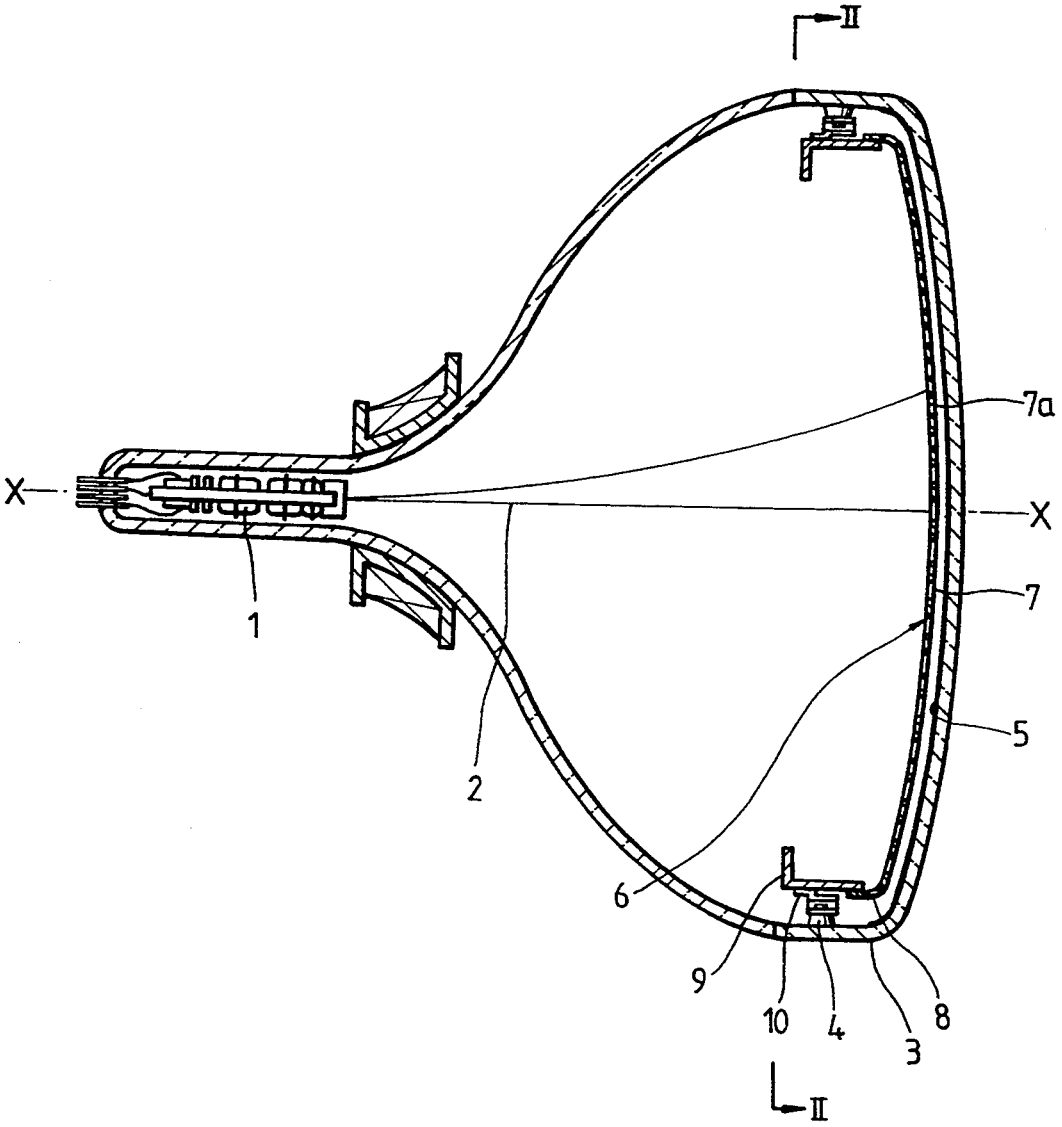
FIG.1 (PRIOR ART)
FIG. 1 shows a schematic cross-sectional view of a conventional CRT.
Figure 2:
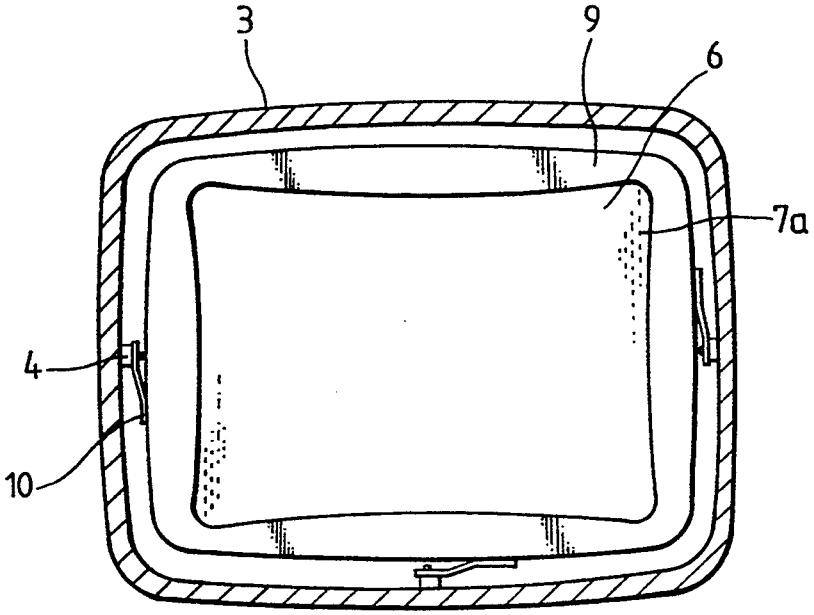
FIG. 2 (PRIOR ART)
FIG. 2 illustrates a section view of the conventional CRT taken along line II—II of FIG. 1.
Figure 3A:
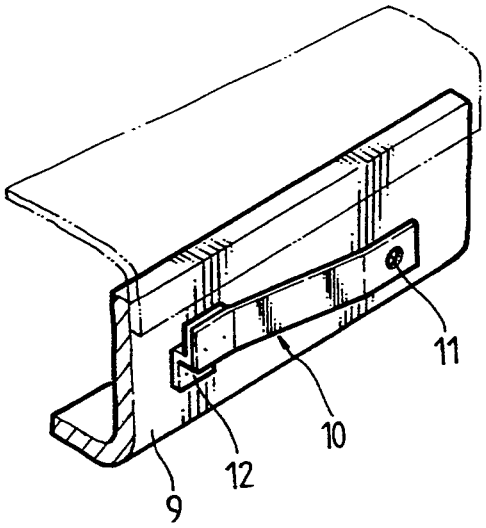
FIG. 3A (PRIOR ART)
FIG. 3A is a partially extracted perspective view of the structure of the conventional hook spring.
Figure 3B:
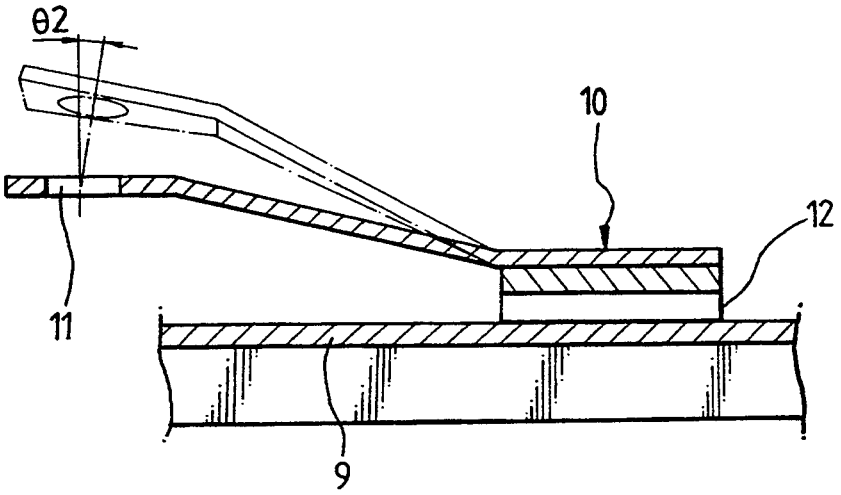
FIG. 3B (PRIOR ART)
FIG. 3B is a cross-sectional view of the conventional hook spring for illustrating its operation.
Figure 3C:
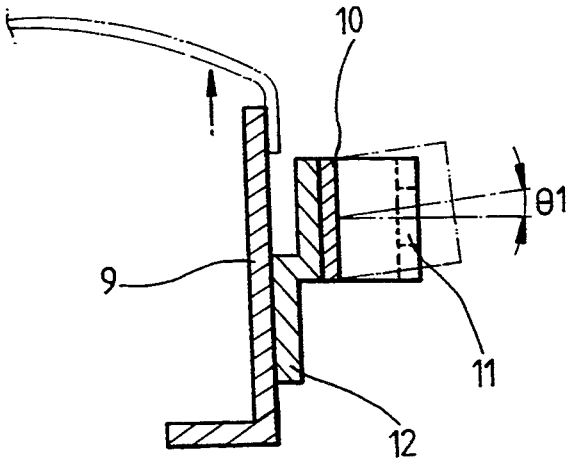
FIG. 3C (PRIOR ART)
FIG. 3C is a vertical sectional view of the conventional hook spring for illustrating its operation.
Figure 4A:
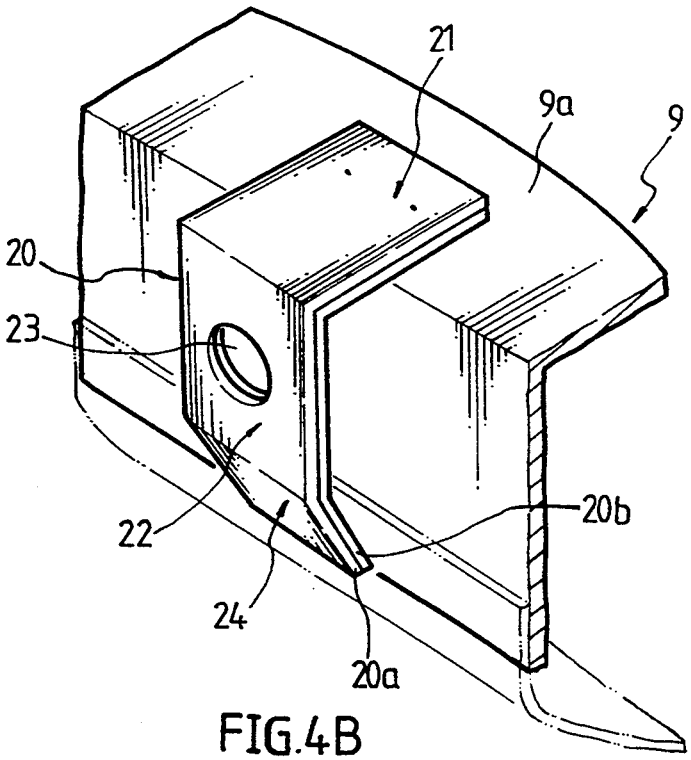
FIG. 4A is a partially extracted perspective view of a hook spring of a shadow mask frame assembly according to the present invention.
Figure 4B:
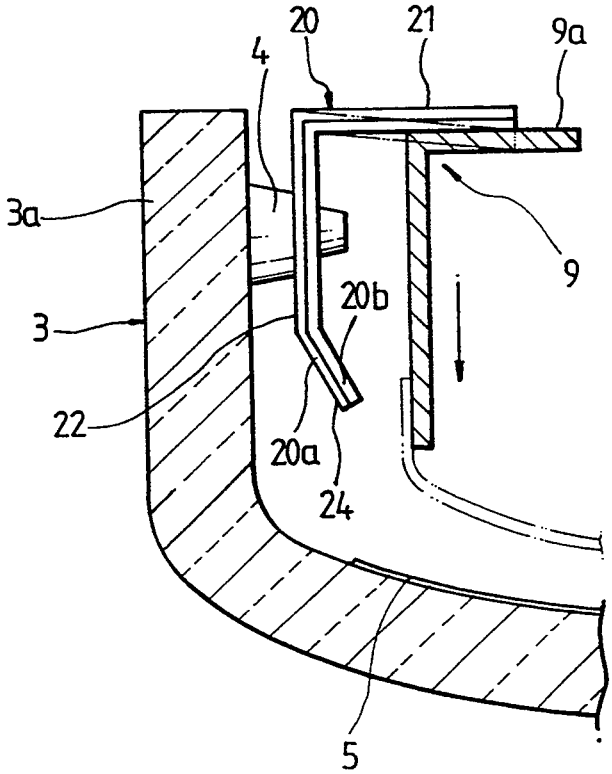
FIG. 4B illustrates a side view of the hook spring of the present invention for illustrating its operation.

In the description of FIGS.4A and 4B, unshown portions of a shadow mask frame assembly are explained with reference to FIGS. 1 and 2. Referring to FIGS. 4A and 4B, a hook spring 20 is made of a stacked bimetal whose outer side is high-expanded (high-expansion side 20*a*) and whose inner side is low-expanded (low-expansion side 20*b*). Preferably, the high expansion side 20*a* is comprised of an Fe-Ni-Cr alloy, while the low expansion side 20*b* is comprised of an Fe-Ni alloy. Hook spring 20 is nearly L-shaped to have a fixing portion 21 welded to a base 9*a* of frame 9, and a fitting portion 22 being folded perpendicular to the fixing portion 21 and having a fitting hole 23 into which stud pin 4 on the inner side of panel is fitted. Fitting portion 22 is substantially parallel with skirt 3*a* of panel 3 and is directed toward phosphor surface 15 formed on the bottom of panel 3. For easy coupling to stud pin 4, a guide portion 24, is formed on the free end of fitting portion 22. The guide portion 24 is offset from the fitting portion 22 by an acute angle, preferably 45°. However, this angle can be varied according to the size and shape of the stud pin.

Now, operation of hook spring 20 of the present invention will be described. When shadow mask 6 is heated due to the collision of electron beam 2 projected from electron gun 1, the heat is transmitted to hook spring 20 via frame 9. Thus, relative to its low-expansion side 20*b*, high-expansion side 20*a* of hook spring 20 expands greatly. As shown in FIG. 4B, the shadow mask frame assembly moves by a certain distance toward phosphor surface 5 formed on the bottom of panel 3. That is, the movement of the shadow mask 6 toward phosphor surface 5 of panel 3 by the certain distance, compensates for the mislanding of electron beam 2 due to the thermal expansion of shadow mask 6. Here, since hook spring 20 of the present invention is bent in an "L" shape and the fixing portion 21 is welded to base 9*a* of frame 9 the fitting portion 22 extends in the direction of the electron beam proceeding axis X—X. The movement of shadow mask 6 during thermal expansion of fixing portion 21 is constricted to be in the direction of the electron beam's proceeding axis X—X. The limitation of the direction of movement prevents the rotation and distortion of the shadow mask frame assembly with respect to panel 3. Further, vibration due to external impacts is prevented to allow sufficient compensation for the thermal deformation of shadow mask 6.

The hook spring 20 of the present invention is very easy to be coupled with stud pin 4 on the inner side of panel 3 because of guide portion 24 formed on the free end of fitting portion 22. This in effect enables the easy mounting of the shadow mask assembly onto the inner side of panel 3.

As described above in detail, the shadow mask frame assembly of the present invention is not distorted or rotated with respect to its panel during the thermal expansion of a shadow mask due to electron beam collision, and is sufficiently compensated only in the direction of the electron beam's proceeding axis. In addition, the present invention can maintain stability without vibrating despite external impacts, thereby realizing a CRT having a sharp picture. Moreover, the manufacture of the present invention is very easy since conventional bimetal and hook springs are of a stacked bimetal material.

While the invention has been particularly shown and described with reference to preferred embodiments thereof, it will be understood by those skilled in the art that various changes in form and details may be made therein without departing from the spirit and scope of the invention as defined by the appended claims.

What is claimed is:

1. A shadow mask frame assembly comprising:

a shadow mask, a frame fixed to said shadow mask, a panel enclosing said shadow mask and said frame, said panel having an inner surface facing said shadow mask and said frame, and an outer surface;

a plurality of stud pins disposed on said panel; and a plurality of hook springs fixed to said frame, each of said hook springs being coupled with a stud pin on an inner surface of said panel, wherein said hook springs define a plate-like bimetal member having a high-expansion outer side and a low-expansion inner side, said hook spring being fixed on said frame in the direction of an electron beam axis, and said hook spring being nearly L-shaped, having a first portion defined as a fixing portion welded to said frame and a second portion defined as a fitting portion having a fitting hole into which a stud pin disposed on the inner surface of said panel is fitted.

2. A shadow mask frame assembly as claimed in claim 1, wherein a guide portion is provided on the free end of the fitting portion of said hook spring, said guide portion being bent in the direction of said frame so as to facilitate the coupling of said hook spring with said stud pin of said panel.

3. A shadow mask frame assembly as claimed in claim 1 wherein each of said plurality of hook springs consists of a unitary bimetal member.

4. A shadow mask frame assembly as claimed in claim 1 wherein each of said plurality of hook springs includes a unitary elastically deformable bimetal member.

5. A shadow mask frame assembly as claimed in claim 4 wherein the first portion is welded to the frame such that the low expansion inner side contacts the frame.

6. A shadow mask frame assembly comprising:

a shadow mask;

a frame affixed to said shadow mask;

a panel encompassing said shadow mask and said frame;

a plurality of stud pins disposed on an inner portion of said panel; and a plurality of hook springs, each of said hook springs including a bimetal member having a high-expansion side and a low expansion side, the bimetal member being substantially L-shaped, having a first portion defined as a fixing portion that is secured to said frame, and a second portion defined as a fitting portion coupled with a stud pin, the fitting portion being disposed substantially perpendicular to said shadow mask.

7. A shadow mask frame assembly as claimed in claim 6, wherein said hook spring further comprises a guide portion extending from the fitting portion and offset from the fitting portion by an acute angle.

8. A shadow mask frame assembly as claimed in claim 7 wherein the angle by which said guide member is offset from the fitting portion is 45°.

9. A shadow mask frame assembly as claimed in claim 6 wherein the high expansion side of the bimetal member is comprised of an Fe-Ni-Cr alloy.

10. A shadow mask frame assembly as claimed in claim 6 wherein the low expansion side of the bimetal member is comprised of an Fe-Ni alloy.

11. A shadow mask frame assembly as claimed in claim 6 wherein the low expansion side of the bimetal member faces said frame.

12. A shadow mask frame assembly as claimed in claim 6 wherein the bimetal member is a unitary elastically deformable bimetal member.

13. A shadow mask frame assembly as claimed in claim 12 wherein the first portion of the bimetal member is welded to the frame such that the low expansion inner side of the first portion of the bimetal member contacts the frame.

14. A shadow mask frame assembly as claimed in claim 13 wherein the first portion of the bimetal member is substantially orthogonal to the second portion of the bimetal member.

* * * * *